United States Patent [19]

Scheel

[11] 4,089,286

[45] May 16, 1978

[54] SAILBOAT KEEL

[75] Inventor: Henry A. Scheel, Rockport, Me.

[73] Assignee: Jeanne Greaves Hall Sheel, Rockport, Me.

[21] Appl. No.: 663,840

[22] Filed: Mar. 4, 1976

[51] Int. Cl.[2] ..... B63B 3/38

[52] U.S. Cl. ..... 114/140; 114/39

[58] Field of Search ..... 114/39, 56, 140–143

[56] References Cited

U.S. PATENT DOCUMENTS

| | | | |
|---|---|---|---|
| 3,080,845 | 3/1963 | Pollak | 114/140 |
| 3,747,550 | 7/1973 | Stoeberl | 114/39 |

FOREIGN PATENT DOCUMENTS

| | | | |
|---|---|---|---|
| 911,740 | 7/1946 | France | 114/56 |

OTHER PUBLICATIONS

Certificate of Award of Number to an Undocumented Vessel, No. 10W2305, U.S. Coast Guard, 8/20/57.

*Primary Examiner*—Trygve M. Blix
*Assistant Examiner*—Sherman D. Basinger
*Attorney, Agent, or Firm*—W. R. Hulbert

[57] ABSTRACT

A sailboat keel, especially for shoal draft sailboats, which reduces turbulence and generated vortices and increases laminar flow along the hull and keel, which comprises a upper portion attachable to the canoe hull and a body portion extending downwardly from the upper portion, the body portion flaring outwardly so as to have a maximum width at its plane of intersection with the keel bottom which is preferably smoothly curved.

11 Claims, 6 Drawing Figures

FIG 1
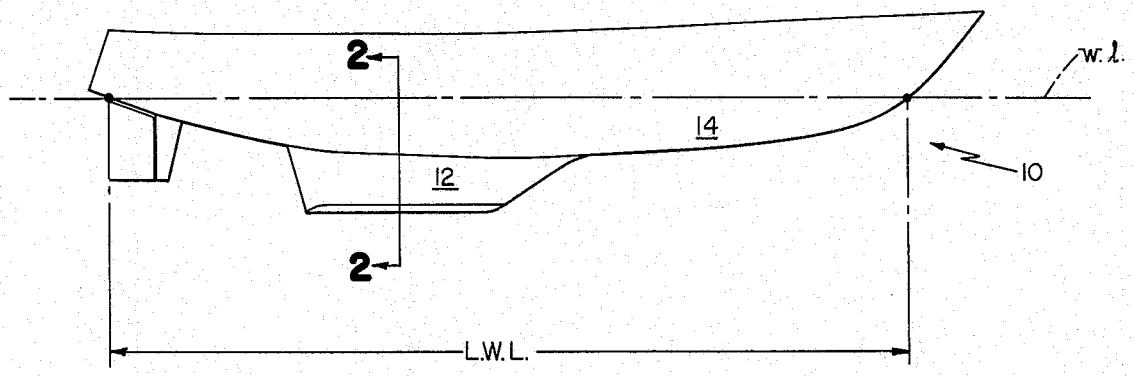
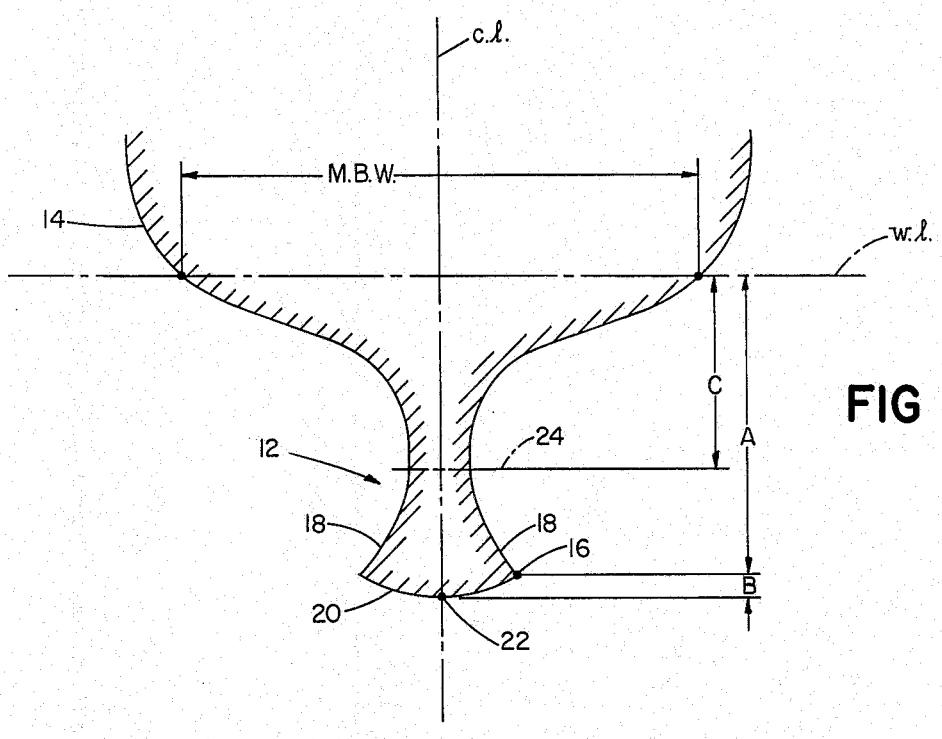
FIG 2

SAILBOAT KEEL

BACKGROUND OF THE INVENTION

This invention relates to sailboat keels.

It is known that the side forces which act on a sailboat proceeding on any course relative to the apparent wind, except directly downwind, may be overcome by hull appendages such as a keel or a centerboard. Known keel shapes, particularly in shoal draft sailboats, produce flow patterns characterized by turbulence and generated vortices, resulting in increased resistance to the forward motion of the boat.

It would be desirable to provide a sailboat keel, without need for an expensive, complex, and troublesome centerboard, which would, at the same time, provide the necessary resistance to side forces even for shoal draft boats and produce a flow pattern characterized by a decreased amount of turbulent flow and generated vortices, and which therefore would result in an increased speed of the sailboat when on the wind.

SUMMARY OF THE INVENTION

The object of the invention is to provide a simple, easy-to-construct, sturdy, reliable, and inexpensive sailboat keel which furnishes the necessary resistance to side forces, which also produces a flow pattern characterized by a decreased amount of turbulent flow and generated vortices, resulting in an increased speed of the sailboat when on the wind, and which manifests these advantages dramatically when applied to shoal draft sailboats.

According to the invention, I provide a novel sailboat keel having an upper portion extending downwardly from the hull and a keel body portion extending further downwardly from the upper portion. The keel body portion is provided with a lower surface which is the bottom of the keel and a pair of lateral surfaces which flare away from the central plane of the keel so that the said portion, in cross-section, widens as it extends downwardly from the base. The keel thereby acts on the fluid particles passing along the hull and keel so as to resist the side forces which act on the hull due to wind pressure on the sails, while creating a flow pattern characterized by a decreased amount of turbulent flow and generated vortices, resulting in an increase in the amount of laminar flow over the hull and keel surfaces and a reduction in energy consumed in the generation of vortices, thereby reducing the fluid resistance to the forward motion of the boat. In preferred embodiments, the above-mentioned lateral surfaces are concave, curving away from the central plane of the keel, and the keel has its minimum cross-sectional width at the upper end of the keel body portion and its maximum cross-sectional width at the plane of intersection of the lateral surfaces with the bottom surface. In preferred embodiments, lines tangent to projections of the aforementioned concave lateral surfaces at their intersections with projections of the bottom surface are disposed at an angle less than of the order of 60° and greater than of the order of 30°, with 34° preferred. Likewise, in preferred embodiments, the bottom of the keel is convexly curved symmetrically about the centerline and preferably is generated by segments of circles, each circle having its lowest extremity at the central plane of the keel and its center on the central plane of the keel.

Other objects, advantages and features of the invention will be apparent from the following detailed description and accompanying drawings of a preferred embodiment.

BRIEF DESCRIPTION OF THE DRAWINGS

FIG. 1 is a side elevation of a shoal draft sailboat hull and keel embodying the invention.

FIG. 2 is a cross-sectional view, somewhat diagrammatic, on line 2—2 of FIG. 1, representing a section at maximum keel width.

Description of the Preferred Embodiment

Figure 3:
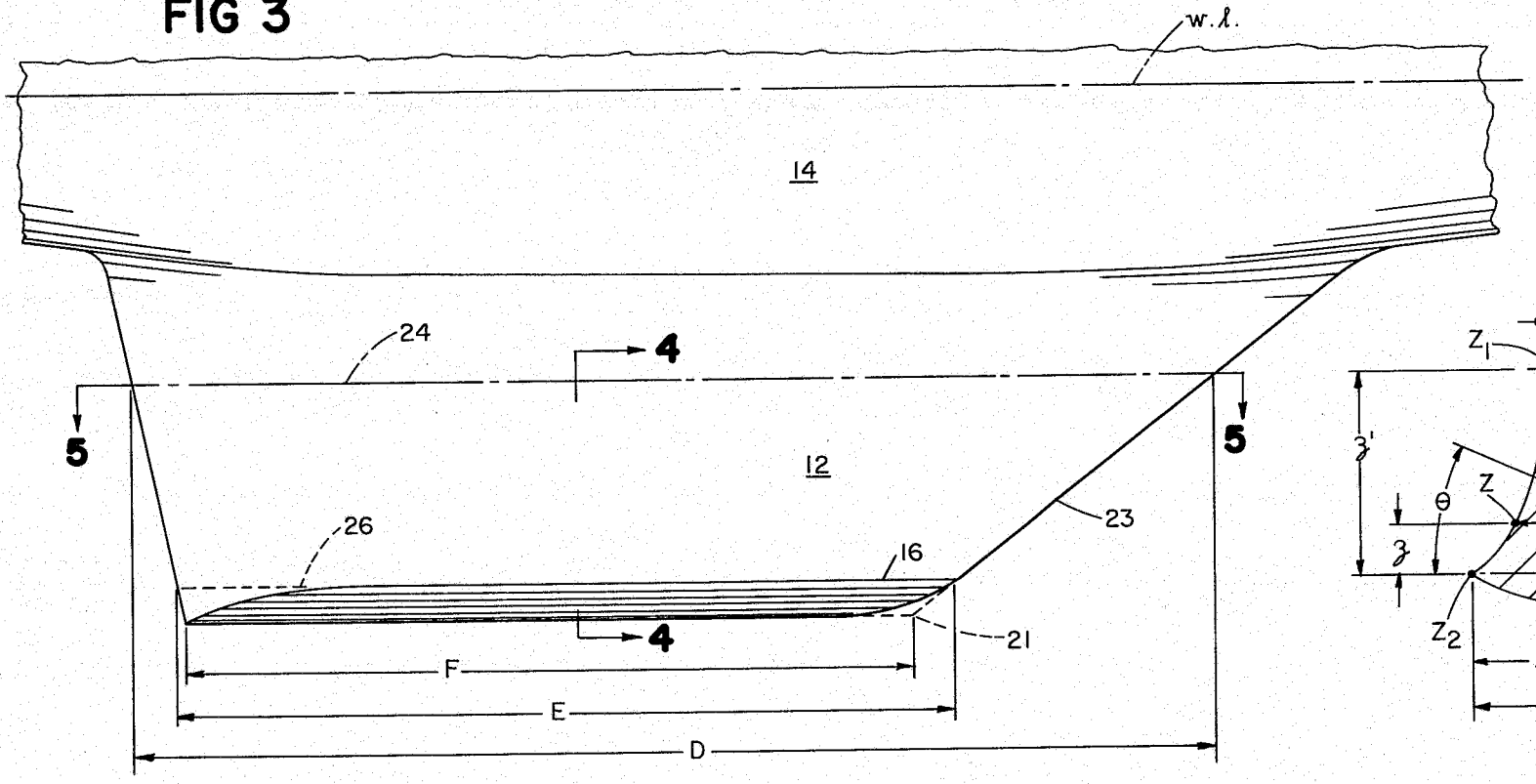
FIG. 3 is an enlarged fragmetary view of FIG. 1.

The drawings illustrate the invention as applied to a shoal draft sailboat, indicated generally by the numeral 10, having a keel 12 and conventional canoe hull 14. The vessel has a load waterline length (L.W.L.) between 15 and 70 feet, which are practical limits for this type of vessel.

Referring now to FIG. 2, the maximum beam width (M.B.W.) at the load waterline level (w.l.) generally is from 0.2 to 0.4 times L.W.L., e.g. between 5 and 19 feet. The vertical distance A from w.l. to the intersections 16 of the projections of the lateral surfaces 18 and the bottom surface 20 of the keel 12 (see FIG. 6) is equal to 0.152 ± 0.038 times L.W.L., with an optimum of 0.142 times L.W.L. The vertical distance B from an intersection 16 to the intersection 22 of bottom surface 20 with the centerline of the keel (which coincides with the centerline c.l.) of the boat) is equal to 0.0100 ± 0.0020 times the vertical distance A, with an optimum of 0.0103 times such distance A. The vertical distance C from w.l. to the plane 24 at minimum keel width is equal to 0.110 ± 0.040 times L.W.L., with an optimum of 0.099 times L.W.L.

Referring now to FIG. 3, showing an enlarged side elevation of the novel keel itself, the length D of the keel at its section 24 of minimum width is equal to 0.472 ± 0.377 times L.W.L., with an optimum of 0.250 times L.W.L. The length E of the keel at its plane 26 of maximum width is 0.362 ± 0.287 times L.W.L., with an optimum of 0.180 times L.W.L. The length F of the keel along its bottom 20 from its stern to projected point 21, the intersection of lines at c.l. along the bottom and the leading edge 23, is equal to 0.335 ± 0.265 times L.W.L., with an optimum of 0.170 times L.W.L.

Figure 4:
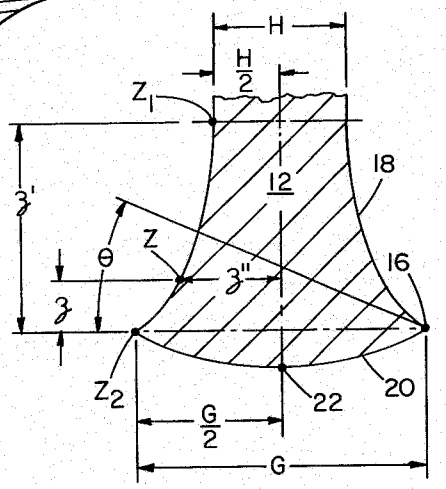
FIG. 4 is a cross-sectional view on line 4—4 of FIG. 3, representing a section at maximum width of a portion of the novel keel.

As seen in FIG. 4, the maximum keel width G is equal to 0.212 ± 0.071 times M.B.W., with an optimum of 0.194 times M.B.W. The minimum keel width H at this section is equal to 0.125 ± 0.040 times M.B.W., with an optimum of 0.0905 times M.B.W. The angle $\theta$ formed by a line tangent to a projection of a lateral surface 18 of the keel at an intersection 16 (see FIG. 6) and the horizontal is preferably about 34°. As already indicated, practical limits for the angle $\theta$ are considered to be from of the order of 30° to not more than about 60°.

Figure 5:
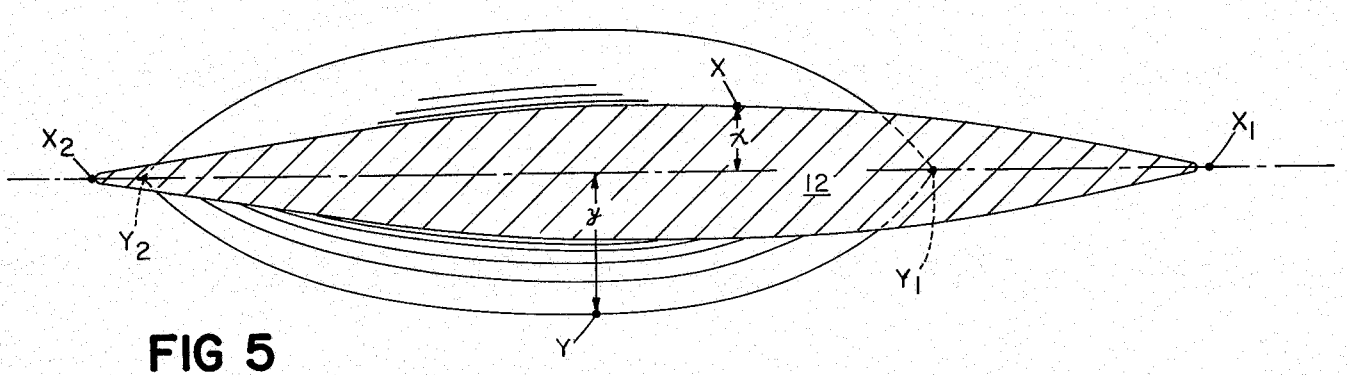
FIG. 5 is a longitudinal sectional plan view taken on line 5—5 of FIG. 3.

Viewed in plan, as seen in FIG. 5, which is a longitudinal section on the plane 24 of minimum keel width, the shape of the two identical minimum keel width curves, $X_1$,X,$X_2$, ideally is derived from Table 1. Column I locates every point X along the curve in terms of the ratio of the distance $\overline{X_1,X}$ along the minimum keel width curve from the forward end $X_1$ of the keel to the point X, to the overall length of the minimum keel width curve $\overline{X_1,X_2}$. Column II is the ratio of the shortest distance x from any point X to the central vertical plane of the keel, which coincides with c.l., to ½ the maximum keel width at the horizontal section of minimum keel width (FIG. 4, dimension H, divided by two).

TABLE 1

| Column I | Column II |
|---|---|
| 0.0125 | 0.25 |
| 0.0250 | 0.35 |
| 0.0500 | 0.48 |
| 0.1000 | 0.66 |
| 0.20 | 0.87 |
| 0.30 | 0.97 |
| 0.40 | 1.00 |
| 0.50 | 0.98 |
| 0.60 | 0.90 |
| 0.70 | 0.78 |
| 0.80 | 0.60 |
| 0.90 | 0.35 |
| 0.95 | 0.19 |
| 1.00 | 0.00 |
| Column I $= \frac{\overline{X_1,X}}{\overline{X_1,X_2}}$ | Column II $= \frac{x}{H/2}$ |

The shape of the two identical maximum keel width curves, $Y_1,Y,Y_2$ (FIG. 5), ideally is derived from TABLE 2. Column III locates a point Y in terms of the ratio of the distance $\overline{Y_1,Y}$ along the maximum keel width curve from the forward end $Y_1$ of the curve to the point Y, to the overall length of the maximum keel width curve $\overline{Y_1,Y_2}$. Column IV is the ratio of the shortest distance y from any point Y to the central vertical plane of the keel, which coincides with c.l., to one-half the maximum keel width (FIG. 4, dimension G, divided by two).

TABLE 2

| Column III | Column IV |
|---|---|
| 0.0125 | 0.064 |
| 0.0250 | 0.18 |
| 0.050 | 0.33 |
| 0.10 | 0.58 |
| 0.20 | 0.81 |
| 0.30 | 0.95 |
| 0.40 | 1.00 |
| 0.50 | 0.96 |
| 0.60 | 0.87 |
| 0.70 | 0.70 |
| 0.80 | 0.49 |
| 0.90 | 0.26 |
| 0.95 | 0.12 |
| 1.00 | 0.00 |
| Column III $= \frac{\overline{Y_1,Y}}{\overline{Y_1,Y_2}}$ | Column IV $= \frac{y}{G/2}$ |

The shape of a lateral surface of the keel between $Z_1$ at minimum width (dimension H) and $Z_2$ at maximum keel width (see FIG. 4) is derived from TABLE 3. Column V locates a point Z in terms of the ratio of the vertical distance z from the point to the intersection $Z_2$ of projections of a lateral surface 18 and the bottom surface 20 of the keel 12 (vertical distance $z$ from Z to $Z_2$), to the vertical distance $z'$ from $Z_1$ to $Z_2$. Column VI is the ratio of the shortest distance $z''$ from a point Z to the central plane of the keel to G/2, one-half the maximum keel width (FIG. 4, dimension G, divided by 2).

TABLE 3

| Column V | Column VI |
|---|---|
| 0.0 | 1.00 |
| 0.1 | 0.90 |

TABLE 3-continued

| Column V | Column VI |
|---|---|
| 0.2 | 0.82 |
| 0.4 | 0.69 |
| 0.6 | 0.60 |
| 0.8 | 0.55 |
| 1.0 | 0.52 |
| Column V $= \frac{z}{z'}$ | Column VI $= \frac{z''}{G/2}$ |

The lower end, i.e. bottom, surface 20 of the keel is preferably generated by segments of circles with centers located along the centerline c.l. of the keel.

The data shown above provide the curves and locates them at critical points in space which are required to generate the three dimensional form of this invention by means of the usual fairing procedures understood and practiced by naval architects.

Figure 6:
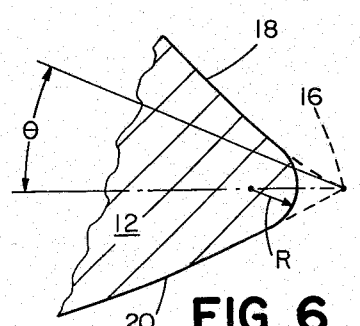
FIG. 6 is a greatly enlarged fragmentary view of FIG. 4 showing how the intersection of a lateral surface and keel bottom are radiused.

Referring now to FIG. 6, showing how the intersection of a lateral surface and keel bottom are radiused, the radius R is equal to 0.045 G ± 0.035 G, with an optimum of 0.030 G. This radius shall be continued forward and abaft of this point by fairing as above.

The foregoing instructions will be found more than adequate by the skilled yacht designer and builder to build keels embodying the invention for vessels of the range of sizes for which they are expected to be most useful. The principles may be expected to apply to larger size vessels, but they are unlikely to be built.

Materials and methods of construction have not been detailed as they are within the skill of yacht designers and builders. Normally, the novel keel would be expected to be solid, and ballasted to increase stability.

The invention is applicable to one of a kind or custom built vessels and also to standard or production vessels with identical hulls to which common size keels, built separately, may be affixed. Likewise, it is within the contemplation of the invention to build replacement keels for fitting to existing vessels.

Experimental use of a shoal draft 30 foot sloop, equipped with a keel according to the invention, has demonstrated surprising performance figures as shown by the following example.

Having shoal draft (3′ 10″) and a waterline length of 26.25 feet, the yacht proceeds to windward in the same manner as though she were equipped with a conventional keel (which would require draft of not less than 5′ 6″) making little leeway. She further has demonstrated her ability to point closer into the wind than conventional keel yachts of her size. Furthermore, in addition to the above competence, she has shown consistent ability to pass yachts so encountered at rates of speed which are extraordinary. Further experiments are continuing at the time of filing this application to determine, more accurately, the precise speeds being attained.

Other embodiments within the invention will be apparent to those skilled in the art.

What is claimed is:

1. A keel structure for a sailboat lying below and affixed to the bottom of the canoe hull thereof, the structure extending downwardly a predetermined distance below the hull load waterline, being disposed between the forward and after ends of said waterline, terminating in a bottom surface convexly curved symmetrically about the longitudinal vertical center plane of the structure, having a minimum transverse width located in a first horizontal plane whose depth below said waterline is equal to 0.110 ± 0.040 times the length of said waterline and a maximum transverse width located in a second horizontal plane above said bottom surface whose depth from said waterline is equal to 0.152 ± 0.038 times the length of said waterline and whose vertical distance above the centerline of said bottom surface is equal to 0.01 ± 0.002 times said second named depth, the transverse width of the structure increasing in concave curvilinear fashion from said minimum width downwardly and outwardly to said maximum width, each pair of opposed curves of intersection with said structure of any horizontal plane, from the plane of minimum transverse width to the plane of maximum width, being oppositely convex, symmetrical and curving toward each other from opposed points of maximum extension from said longitudinal vertical center plane to points of mutual intersection at the forward and after ends of the structure, respectively, whereby said structure presents smooth concave boundaries extending both forward and aft of its maximum width.

2. The structure as claimed in claim 1 wherein the transverse cross section is constructed in accordance with Table 3 wherein G designates the maximum width of the structure on said second plane, $z'$ designates the vertical distance between said first and second planes, and $z''$ designates the horizontal distance of an arbitrary point along a lateral curve of the transverse cross section at maximum width from the longitudinal vertical center plane of said structure at various vertical distances $z$ upward from said second plane, Table 3 being as follows:

| $\frac{z}{z'}$ | $\frac{z''}{G/2}$ |
|---|---|
| 0.0 | 1.00 |
| 0.1 | 0.90 |
| 0.2 | 0.82 |
| 0.4 | 0.69 |
| 0.6 | 0.60 |
| 0.8 | 0.55 |
| 1.0 | 0.52. |

3. The structure as claimed in claim 2 wherein $Y_1$ designates the forward point of intersection of the opposed curves generated by intersection with said structure of said second plane, $Y_2$ designates the corresponding after point of intersection thereof, Y designates an arbitrary point along one of said curves, $\overline{Y_1Y_2}$ designates the curvilinear distance between $Y_1$ and $Y_2$, $\overline{Y_1Y}$ designates the curvilinear distance between $Y_1$ and Y, and $y$ designates the horizontal distance of the point Y from the centerplane of the structure, Table 2 being as follows:

| $\frac{\overline{Y_1Y}}{\overline{Y_1Y_2}}$ | $\frac{y}{G/2}$ |
|---|---|
| 0.0125 | 0.064 |
| 0.0250 | 0.18 |
| 0.050 | 0.33 |

-continued

| $\frac{\overline{Y_1Y}}{\overline{Y_1Y_2}}$ | $\frac{y}{G/2}$ |
|---|---|
| 0.10 | 0.58 |
| 0.20 | 0.81 |
| 0.30 | 0.95 |
| 0.40 | 1.00 |
| 0.50 | 0.96 |
| 0.60 | 0.87 |
| 0.70 | 0.70 |
| 0.80 | 0.49 |
| 0.90 | 0.26 |
| 0.95 | 0.12 |
| 1.00 | 0.00. |

4. The structure as claimed in claim 3 wherein each curve of intersection with said structure generated by said first plane is defined by Table 1 wherein H designates the maximum width of said structure at said plane, $X_1$ designates the forward point of intersection of said curves, $X_2$ designates the after point of intersection of said curves, X designates an arbitrary point on one of said curves, $\overline{X_1X_2}$ designates the curvilinear distance from $X_1$ and $X_2$, $\overline{X_1X}$ designates the curvilinear distance between $X_1$ and X and x designates the distance of the point X from the vertical longitudinal centerplane of the structure, Table 1 being as follows:

| $\frac{\overline{X_1X}}{\overline{X_1X_2}}$ | $\frac{x}{H/2}$ |
|---|---|
| 0.0125 | 0.25 |
| 0.0250 | 0.35 |
| 0.0500 | 0.48 |
| 0.1000 | 0.66 |
| 0.20 | 0.87 |
| 0.30 | 0.97 |
| 0.40 | 1.00 |
| 0.50 | 0.98 |
| 0.60 | 0.90 |
| 0.70 | 0.78 |
| 0.80 | 0.60 |
| 0.90 | 0.35 |
| 0.95 | 0.19 |
| 1.00 | 0.00. |

5. The structure as claimed in claim 4 wherein said structure is of shallow draft, said bottom surface extending below the load waterline to a depth between 0.115 and 0.19 times the length of said waterline.

6. The structure as claimed in claim 4 wherein said bottom surface is curvilinear and generated by segments of circles.

7. The structure as claimed in claim 3 wherein said structure is of shallow draft, said bottom surface extending below the load waterline to a depth between 0.115 and 0.19 times the length of said waterline.

8. The structure as claimed in claim 3 wherein said bottom surface is curvilinear and generated by segments of circles.

9. The structure as claimed in claim 2 wherein said structure is of shallow draft, said bottom surface extending below the load waterline to a depth between 0.115 and 0.19 times the length of said waterline.

10. The structure as claimed in claim 1 wherein said structure is of shallow draft, said bottom surface extending below the load waterline to a depth between 0.115 and 0.19 times the length of said waterline.

11. The structure as claimed in claim 1 wherein said bottom surface is curvilinear and generated by segments of circles.

* * * * *

UNITED STATES PATENT AND TRADEMARK OFFICE

CERTIFICATE OF CORRECTION

PATENT NO. : 4,089,286

DATED : May 16, 1978

INVENTOR(S) : Henry A. Scheel

It is certified that error appears in the above-identified patent and that said Letters Patent are hereby corrected as shown below:

The Assignee's name is misspelled; it should be --Jeanne Greaves Hall Scheel--;

Column 2, Line 37, "centerline c.l.)" should be --centerline (c.l.)--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*